US005368723A

United States Patent [19]

Takahashi et al.

[11] Patent Number: 5,368,723

[45] Date of Patent: Nov. 29, 1994

[54] METHOD OF AND APPARATUS OF PRODUCING LOW BOILING POINT HYDROCARBON OIL FROM WASTE PLASTICS OR WASTE RUBBERS

[75] Inventors: Toshiki Takahashi; Yoshio Tanimoto, both of Hiroshima, Japan

[73] Assignee: Mazda Motor Corporation, Hiroshima, Japan

[21] Appl. No.: 15,982

[22] Filed: Feb. 10, 1993

[30] Foreign Application Priority Data

Feb. 10, 1992 [JP] Japan ..... 4-023787
Jul. 9, 1992 [JP] Japan ..... 4-182558

[51] Int. Cl.[5] ..... C10G 1/00; C10B 57/04; C10B 21/20

[52] U.S. Cl. ..... 208/427; 208/435; 208/370; 201/2.5; 201/25; 201/27; 202/99; 202/121; 422/171; 422/177; 422/184; 422/211

[58] Field of Search ..... 208/427, 435, 370; 201/2.5, 25, 27; 202/99, 121; 422/171, 177, 184, 211

[56] References Cited

U.S. PATENT DOCUMENTS 2,567,802 9/1951 Carr et al. ..... 260/711
3,945,810 3/1976 Saito ..... 202/121
3,984,288 10/1976 Yoshida et al. ..... 201/2.5
3,996,022 12/1976 Larsen ..... 44/1 D

FOREIGN PATENT DOCUMENTS 63-178195 7/1988 Japan .

*Primary Examiner*—Paul Lieberman
*Assistant Examiner*—Patricia L. Hailey
*Attorney, Agent, or Firm*—Keck, Mahin & Cate

[57] ABSTRACT

Waste plastics are heated so as to be thermally decomposed and produce a vapor product containing oil and gas components. The vapor product is brought into contact with a solid acid catalyst containing a hydrochloric acid as a decomposing activator to be cracked so as to recover a low boiling point hydrocarbon oil.

11 Claims, 4 Drawing Sheets

METHOD OF AND APPARATUS OF PRODUCING LOW BOILING POINT HYDROCARBON OIL FROM WASTE PLASTICS OR WASTE RUBBERS

BACKGROUND OF THE INVENTION

1. Field of the Invention

This invention relates to a method of and an apparatus for producing a low boiling point hydrocarbon oil from thermally decomposed or decomposed waste plastic or waste rubber.

2. Description of Related Art

Synthetic resins or plastics and synthetic rubbers have quite likely been accepted in every area for a very extensive range of applications, and are taken for granted in our modern daily lives. As a result, a considerably large amount of plastic and rubber is produced, consumed and wasted every day. Because synthetic materials do not exist as natural resources and are artificially produced, they do not decompose or disappear if only left in nature, but remain as material or physical waste in the environment. This is a problem which is being given particular attention by developed countries.

However troublesome the waste plastic products might be, in their original state, they were simply oil. Hence, it is thought that with an appropriate treatment, they might be returned to a hydrocarbon oil similar to petroleum. In this regard, rather than handling used plastic materials as wastes, they might be regarded as a resource.

In such a circumstance, with regard to recycling of a polyolefin type of plastics which are abandoned as wastes in overwhelmingly great quantities, a notable method has been proposed in, for instance, Japanese Unexamined Patent Publication 63-178195 to produce low boiling point hydrocarbon oil from the polyolefin plastics. With this method, the plastics in liquid phase are thermally decomposed and transformed into gaseous products. The resultant gaseous products are subjected to a catalytic transformation in a cell filled with zeolite which possesses specified characteristics. This method produces only a considerably reduced amount of useless wax during the process oil thermal decomposition or decomposing and provides a high yield of useful low boiling point hydrocarbon oil which is liquid at room temperatures.

However, although the wasted amount of polyolefin plastics is considerable, this is not the only type of plastics which are abandoned. Since plastic wastes generally include various types of plastics in a mixed state, it would be extremely difficult to remove only the polyolefin plastic from the others. Accordingly, the polyolefin plastic waste is treated as a mixture with other types of plastics. Such a plastic waste often includes a chlorine type of plastics, such as polyvinyl chloride and polyvinylidene chloride. When thermally decomposing or decomposing chlorine type plastics and chlorine type rubbers, a large amount of chloride compounds, such as hydrochloric acids, and chlorine gases are produced. Since these chlorine gases and chloride compounds are highly reactive, and consequently, are abundantly toxic and corrosive, not only do they corrode the equipments used for treatment, but they also have the disadvantage of corroding the zeolite catalytic material and, thereby, reducing its performance For this reason, the prior method described in the publication is unavailable to be used with plastic wastes including the chlorine type of plastics and rubbers.

SUMMARY OF THE INVENTION

It is an object of the present invention to provide a method of and an apparatus for producing a low boiling point hydrocarbon oil from waste plastics and/or rubber by thermally decomposing them, even if the waste plastics and rubber contain a chlorine type of plastics or rubber, and to obtain is sufficiently decomposed and recovered hydrocarbon oil with a high yield.

The method of producing a low boiling point hydrocarbon oil includes a step of heating waste plastics to thermally decompose them so as to produce a gaseous or vapor product containing oil and gas components, and a step bringing the vapor product into contact with a catalyst formed by a solid acid catalyst with hydrochloric acid contained as a decomposing activator. Through the contact with the solid acid catalyst, the vapor product is "cracked," thereby providing a lowing boiling point hydrocarbon oil. The solid acid catalyst with hydrochloric acid contained as a decomposing activator is superiorly resistive in toxicity and corrosion against chlorine compounds. Furthermore, there is good cracking performance of plastic materials in the presence of hydrochloric acid. Therefore, through the thermal decomposing of the chlorine type of plastics, there is no possibility that the catalytic layer suffers poisoning caused by hydrochloric acid produced by thermal decomposing, whereas the thermal decomposing of plastic materials is promoted in the presence of hydrochloric acid.

The apparatus for producing a low boiling point hydrocarbon oil from waste plastics and/or rubber includes a thermal decomposing means which heats pulverized waste plastics to decompose the waste plastics so as to produce a vapor product containing an oil component and a gas component. The thermal decomposing means is divided into two decomposing chambers, such as a thermal decomposing chamber and a catalytical decomposing chamber. In the thermal decomposing chamber, the pulverized waste plastic substances are thermally decomposed to produce the vapor product. On the other hand, in the catalytic decomposing chamber, which is filled with a solid acid catalyst with hydrochloric acid contained as a decomposing activator, the vapor product is brought into contact with the catalyst and cracked. The vapor product is cooled to condense the oil component. Through a gas-liquid separation means, the condensed oil component is separated from the gas component. The gas component, from which the oil component has been separated, is burned in heat means to produce hot combustion gases which are introduced into and heat the thermal decomposing means.

BRIEF DESCRIPTION OF THE DRAWINGS

The above and other objects and features of the present invention will be clearly understood from the following description with respect to preferred embodiments thereof when considered in conjunction with the accompanying drawings, in which similar or the same references have been used to denote similar structural elements throughout the drawings, and in which.

DETAILED DESCRIPTION OF THE PREFERRED EMBODIMENTS

Figure 1:
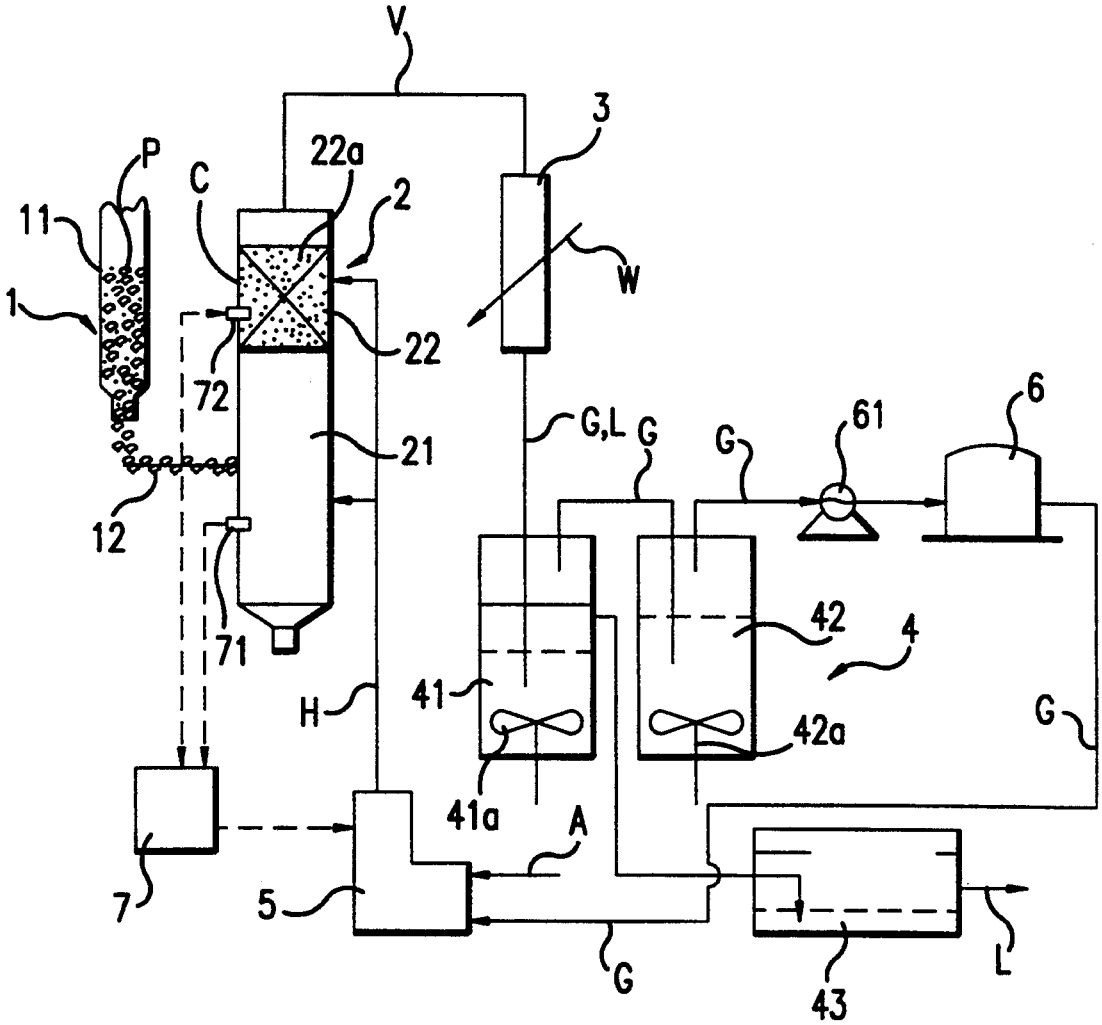
FIG. 1 is a schematic illustration showing a thermally decomposing apparatus for recovering or producing a low boiling point decomposed oil from plastic and/or rubber wastes in accordance with a preferred embodiment of the present invention.

The method of recovering or producing a low boiling point hydrocarbon oil from plastic wastes or synthetic rubber wastes (hereafter referred to as plastic wastes for simplicity) in accordance with a preferred embodiment of the present invention basically includes thermally decomposing or thermal decomposition of plastic wastes to produce products approximately equivalent to their original or starting materials. "Plastics," as used in the specification, are not limited to specific types of plastics, but range from general purpose plastics to high performance engineering plastics. General purpose plastics include, for example, polyethylene resins, polypropylene resins, polystyrene resins, acrylonitrile-butadiene styrene resins, polymethyl-methacrylate resins, polyvinyl alcohol resins, etc. In addition, as high performance engineering plastics, utilization may be made of polyamide resins, polyacetal resins, polycarbonate resins, polyphenylene ether resins, polybutylene-terephthalate resins, polysulfon resins, polyether sulfon resins, polyphenyl-sulfide resins, polyaclylate resins, polyimide resins, polyamideimide resins, polyether-etherketone resins, etc. On the other hand, "rubbers" as used in the specification shall not be limited to specific types but shall include synthetic rubbers and natural rubbers. Synthetic rubbers include styrenebutadene rubber, high styrene rubber, butadene rubber, isoprene rubber, ethylene propylene rubber, ethylenepropylene-diene rubber, acrylnitrylbutadiene rubber, chloroprene rubber, butyl rubber, urethane rubber, etc.

The particularly significant advantage of the method of the present invention is the fact that, as waste plastic materials, utilization is also made of chlorine type of plastics. Chlorine type plastics, which are typically available, include polyvinylchloride resins, polyvinylidene chloride resins, etc. As a chlorine type rubber, chloroprene rubber is also typical. In particular, favorable utilization may be made of a polyolefin type of hydrocarbons, including polyvinyl chloride and polyvinylidene chloride, polyurethane, polyesters and polyamides, and their copolymers or their mixtures.

In this instance, because plastics and rubber are inherently polymers derived from hydrocarbons, they have poor refractory properties compared to metals and inorganic substances. Even specially processed refractory plastics are resistive to heat only up to a temperature as high as 300 degrees in Centigrade. If such a plastic is heated above this resistive temperature, it suffers thermal decomposing and transforms to a substance of a low molecular weight similar to its starting substance. For this reason, in the method of this invention, thermal decomposition or decomposing of the waste plastics is accomplished in the temperature range of from 250 to 450 degrees Centigrade. When waste plastics were thermally decomposed in this temperature range, according to the invention, the waste plastics were broken down at polymerization bond thereby to be thermally decomposed or decomposed into hydrocarbon compounds similar to substances of low molecular weight before their polymerization.

Ordinarily, hydrocarbons, produced through thermal decomposition or decomposing in the temperature range mentioned above, are generally gaseous or vaporized. When no special precautions are taken, great variety and dispersion occurs in components of the gaseous hydrocarbons produced. For example, hydrocarbons are produced, in some cases, in a state containing deposited carbon as soot, and, in some cases, with inclusions of fine oil mists in a state of considerably viscous fluid. Accordingly, the yield of decomposed oil recovered as low boiling point hydrocarbon oil is very low.

Furthermore, when waste plastics include a chlorine type of plastics, as was previously described, chlorine or hydrochloric acid is produced during thermal decomposing, which causes the disadvantage of progressive corrosion of the equipment and machinery and functional deterioration of the catalyst.

From the viewpoint of the above, in the method of this invention, vapor products, produced by thermal decomposing accomplished within the temperature range of from 250 to 450 degrees Centigrade, are introduced into a cell filled with a solid acid catalytic compound accompanied by hydrochloric acid which serves as a decomposing activator so as to effect catalytic decomposition in conjunction with the solid acid catalytic compound. For a substrate of the solid acid catalytic compound utilization is made of Lewis acids which function as a Bronsted acid when they are added with hydrochloric acid. Available as Lewis acids are, for example, aluminum trichloride ($AlCl_3$), ferric chloride ($FeCl_3$), gallium trichloride ($GaCl_3$), antimony pentachloride ($SbCl_3$), zirconium tetrachloride ($ZrCl_4$), and (tintetrachloride) ($SnCl_4$). Among these, aluminum trichloride ($AlCl_3$) is particularly most suitable. In most instances, the substrate of these solid acid catalysts is used in the form of hydrous salt (hydrates). However, these may also be utilized in the form of anhydrous salt. If utilized as anhydrous salts, these catalysts experience catalytic loss through direct sublimation when heated. However, when utilized in the form of hydrous salt, they are never subjected to direct sublimation, making it possible to hold down catalytic loss.

The substrates of the solid acid are finely pulverized and utilized in a mixture with waste plastics. Otherwise, they are mixed with fine carrier particles of, for instance, kaolin or white clay and, after adding a small amount of appropriate binding substance, are formed under pressure into a desired shape of granule having a grain size or diameter of approximately 0.1 mm–10.0 mm. and arranged in the form of catalytic layer. With the impregnation of hydrochloric acid into the granular substrates of the solid acid, there is formed a solid acid catalyst accompanied by the hydrochloric acid as a decomposing activating agent. The hydrochloric acid, which is impregnated within the granular substrates of the solid acid catalytic substances, preferably is a product resulting from the reaction of chlorine produced through the thermal decomposing of the chlorine type of plastics in plastic wastes combining with moisture or aqueous components in the ambient air or in the plastics themselves. Accordingly, the method of the present invention eliminates the separate preparation of hydrochloric acid and a separate step to effect the impregnation of the hydrochloric acid into the substrate of solid acid in order to produce the solid acid catalyst. That is, the granular substrates are filled in a cell to a specified level of column to provide a sufficient depth of catalytic layer. When first supplying a vapor product resulting from the thermal decomposing of waste plastics containing the chlorine type of waste plastics into the cell filled with solid acid catalyst, hydrochloric acid contained within the vapor product is absorbed and impregnated into the granular catalytic substances to create the solid acid catalyst accompanied by the hydrochloric acid as a decomposing activating agent. Consequently, subsequently, the vapor product is uniformly and expeditiously decomposed by means of the solid acid catalyst in the cell, to produce a raw material of hydrocarbon oil or naphtha with a desired high yield. In this instance, the initial treatment of absorbing hydrochloric acid into the solid acid catalyst is performed in the same temperature range as that of the thermal decomposing that subsequently follows, namely from about 250 to about 450 degrees Centigrade.

Referring to FIG. 1, an apparatus for producing a hydrocarbon oil from waste plastics in accordance with a preferred embodiment of the present invention is schematically shown. The apparatus includes a thermal decomposing or decomposing cell or column 2 in which thermal decomposing or decomposition of waste plastics P takes place. In the hopper 11, there is stored the waste plastics which have been finely pulverized to a specified size. The waste plastic particles P are fed into the bottom section of the thermal decomposing cell 2 by the screw conveyor 12. The thermal decomposing cell 2 is provided with a heat furnace 5 which supplies heated gas H to the waste plastics E in the thermal decomposing cell 2. The waste plastics is introduced into the thermal decomposing cell 2 by a hopper means 1 having a hopper 11 and a screw conveyor 12. A vaporized product V produced in the thermal decomposing cell 2 is introduced into and cooled by a cooling means 3, and provided as a mixture of decomposed oil liquid L and decomposed gas G. The oil and gas mixture is introduced into and separated by a liquid-gas separator system 4.

The thermal decomposing cell 2 is a vertically positioned cylindrical heat tank, the lower section of which, i.e. the upstream section as viewed with respect to the flow direction of the decomposed or decomposed oil and gas, is provided as a thermal decomposing cavity 21. On the other hand, the upper section of the cylindrical heat tank, above the thermal decomposing cavity 21, i.e. the downstream section, is formed as a catalytic decomposing or decomposing chamber 22 filled with the solid acid catalyst C with a decomposing activator of hydrochloric acid which promotes thermal decomposing of the mixture. In this embodiment, as a catalytic component, aluminum trichloride ($AlCl_3$) with a specified amount of hydrochloric acid added thereto is used in the form of granules ranging in size or diameter from 0.1 mm to 10.0 mm. The solid acid catalyst C filled in the catalytic decomposing chamber 22 of the cell 2 forms a catalyst layer 22*a*. The supply of heat to the thermal decomposing cell 2 is accomplished by heated gas H which is produced by the heat furnace 5. The inside of the cell 2, i.e. both insides of the thermal decomposing chamber 21 and the catalytic decomposing chamber 22, is maintained in a temperature in the range of from 350 to 450 degrees Centigrade and under ordinary room pressure i.e. 1 atm.

The cooling means 3, which comprises a heat exchanger, heat exchanges the vaporized product V i.e. the mixture of liquid and gas, expelled from the thermal decomposing cell 2 with a cooling water W. The cooled liquid and gas mixture is then introduced into the liquid-gas separator system 4. The liquid-gas separator system 4 includes a primary neutralizing tank 41, a secondary neutralizing tank 42 and a reservoir 43. The primary neutralizing tank 41 contains therein a neutralizing liquid agent for neutralizing primarily the decomposed oil A of the mixture introduced from the cooling means 3. For the neutralizing liquid agent, a 30% concentration of ammonia water is used. In order to effectively accomplish the neutralizing reaction of the oil L, a stirring means 41*a* having agitation blades is installed in the primary neutralizing cell 41. The secondary neutralizing tank 42 contains therein a neutralizing liquid agent for neutralizing primarily the gas G introduced from the primary neutralizing tank 41. For the neutralizing liquid agent, a 30% concentration of ammonia water is also used. The gas ,G is introduced as bubbles into the ammonia water and brought into contact with the ammonia water, so as to be neutralized. Similarly to the primary neutralizing tank 41, the secondary neutralizing tank 42 is provided with a stirring means 42*a* having agitation blades installed therein. In place of the 30% concentration of ammonia water, sodium hydroxide, sodium carbonate, and sodium hydrogen carbonate can be used for neutralizing the decomposed liquid L and the decomposed gas G. The decomposed gas G, having contacted with the ammonia water in the secondary neutralizing tank 42, is treated so that its chlorine component is neutralized and is removed therefrom. Thereafter, the gas G with its chlorine component removed is aspirated by a blower 61 and then introduced into a reservoir 6. The gas G stored in the reservoir 6 be utilized as fuel in the heat furnace 5.

The reservoir 43 is provided to separate water from the decomposed oil L after the decomposed oil L has been neutralized in the primary neutralizing tank 41. The decomposed oil L is kept still or quiescent in the reservoir 43 so as to cause the oil component to come to the surface. The top clear part of the decomposed oil L in the reservoir 43 is collected as a low boiling point hydrocarbon oil product available as a raw material of fuel oil or naphtha. Chlorine compounds of chlorine and hydrochloric acid, intermediately produced during the thermal decomposing of the chlorine type of plastics are neutralized in both primary and secondary neutralizing tanks 41 and 42 and transformed into salts, which are removed and treated for treatment.

The heat furnace 5 is a fuel burning equipment which is supplied with the decomposed gas G from the reservoir 6 and burns it to supply heat gas H to the thermal decomposing cell 2. In order to burn the gas G, the heat furnace 5 is supplied with a specified quantity of air A to provide a combustible fuel mixture therein. After burning, exhaust gas from the heat furnace 5 is utilized as the decomposing heated gas H. The heat gas H is divided into two parts, one part being supplied to the thermal decomposing cavity 21 of the thermal decomposing cell 2, and the other part being supplied to the catalytic decomposing or decomposing chamber 22 of the thermal decomposing cell 2. Dividing the heat gas H generated by the same heat source into two parts and supplying these parts of heat gas H into the thermal decomposing region 21 and the catalytic decomposing or decomposing chamber 22, respectively, allows the interiors of both thermal decomposing region 21 and catalytic decomposing or decomposing chamber 22 to be simultaneously controlled and maintained at the same temperature by appropriately managing the distribution of the heat gas H to the thermal decomposing region 21 and catalytic decomposing or decomposing chamber 22.

The temperature control of the inside of the thermal decomposing cell 2 is accomplished by means of a controller 7 including primary and secondary thermometers 71 and 72 provided in association with the thermal decomposing chamber 21 and catalytic decomposing chamber 22 of the thermal decomposing cell 2, respectively. These primary and secondary thermometers 71 and 72 monitor the temperatures of the interiors of the thermal decomposing chamber 21 and catalytic decomposing chamber 22, respectively, to provide temperature signals to the controller 7. The controller 7 compares the detected temperatures with specified or predetermined or preselected temperatures, respectively, to increase or decrease heat energies delivered into the thermal decomposing chamber 21 and catalytic decomposing chamber 21 and 22 by the heat gas H on the basis of the result of comparison. This controller 7 makes use of a feedback control.

In the apparatus as described above, the waste plastics P of a specified granular size e.g. 001 to 10 mm are supplied into the thermal decomposing chamber 21 of the thermal decomposing cell 2 by means of the screw conveyer 12 from the hopper 11, and then, heated to a specified temperature by the heat gas H supplied from the heat furnace 5 to be thermally decomposed. A vaporized product produced by the primary thermal decomposing rises as an airstream or fluestream and reaches the catalyst layer 22*a* in the catalytic decomposing chamber 22, downstream from the thermal decomposing chamber 21, of the thermal decomposing cell 2. Consequently, the vaporized product comes into contact with the solid acid catalyst layer 22*a* in the catalytic decomposing chamber 22 to be catalytically decomposed and expelled out as a secondary vaporized product V from the thermal decomposing cell 2. When the vaporized product V is introduced into the cooling means 3, it is cooled through a heat exchange (indirect) with the coolant water W. As a result of this heat exchange, the oil component L within the vapor product V is condensed and liquefied, and, on the other hand, the remaining component, i.e. the decomposed gas G, is mixed with and held in the liquefied oil L. The gas-liquid mixture is introduced into the primary neutralizing tank 41 of the liquid-gas separator system 4. After the liquefied oil L is neutralized by means of the ammonia water, it is expelled into the reservoir 43. In the reservoir 43, the liquefied oil L is left still or quiescent so that oil component is separated from water and comes to the surface. The top clear part of the liquid in the reservoir 43 is collected as a low boiling point hydrocarbon oil product available as a raw material of fuel oil or naphtha.

On the one hand, the gas G, separated within the primary neutralizing tank 41, is introduced into the secondary neutralizing tank 42 to be brought into contact with the ammonia water. As a result, the chlorine component within the gas G is neutralized and removed. Thereafter, the gas G is expelled out by the blower 61 into the reservoir 6. The gas G is supplied, as necessary, to the heat furnace 5 wherein it is mixed with air A to provide a combustible fuel mixture.

Lewis acid utilized as a catalytic component of the solid acid catalyst is free from functional deterioration which is unavoidable for the conventional catalyst containing zeolite as its main component in the presence of chlorine and/or chlorine compounds. In addition, because of the formation of hydrochloric acid, the vaporized product improves its own decomposing power, thereby stably providing a high quantity of a high quality low boiling point hydrocarbon oil available as a raw material or feedstream of fuel oil or naphtha.

In addition, since, the heated gas H which is delivered from the same heat source, i.e., the heat furnace 5, is supplied into both thermal decomposing chamber 21 and catalytic decomposing chamber 22 of the thermal decomposing cell 2, the temperature control is easily and desirably accomplished by the controller 7.

Figure 2:
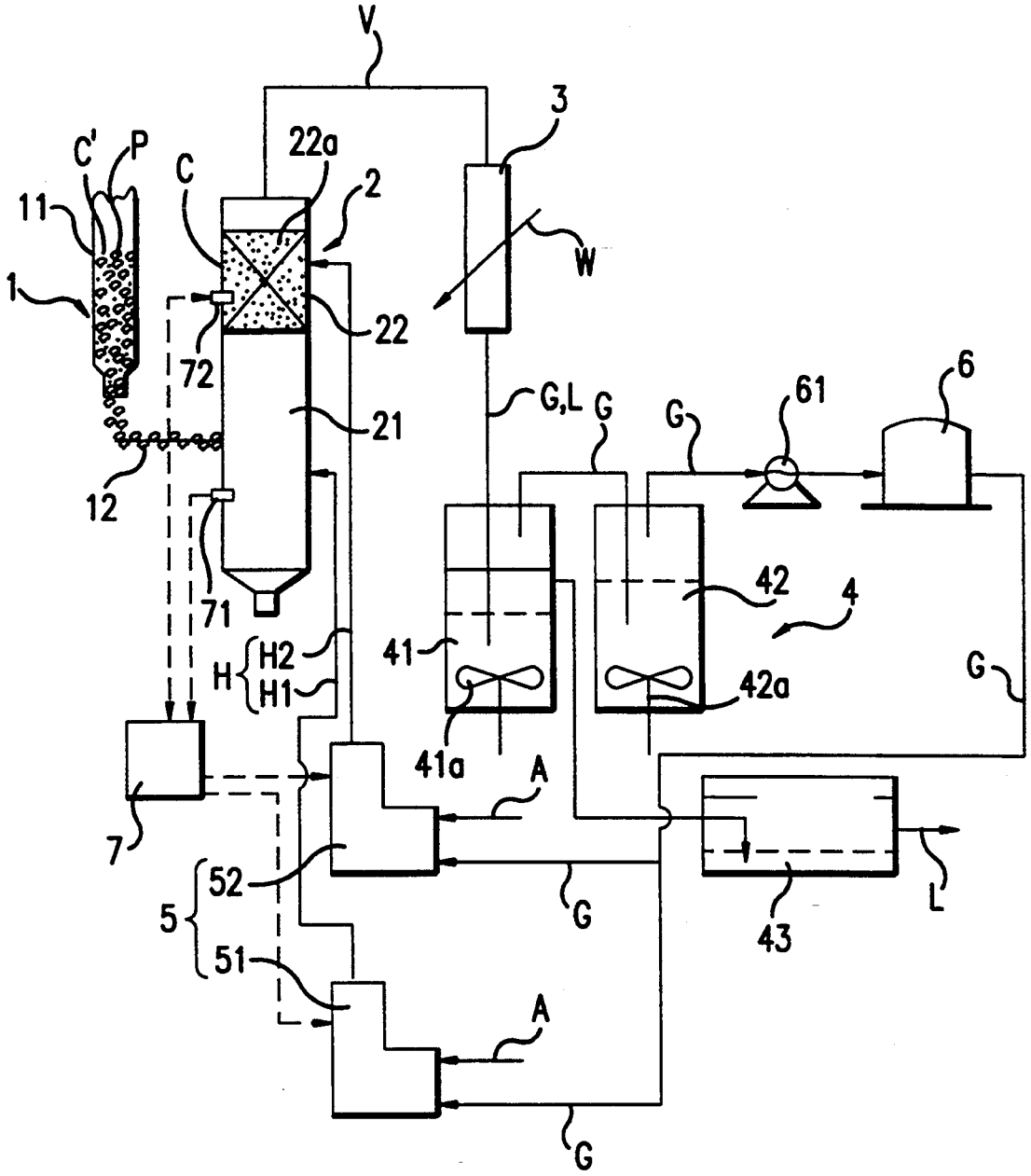
FIG. 2 is a schematic illustration showing a thermally decomposing apparatus for recovering or producing a low boiling point decomposed oil from plastic and/or rubber wastes in accordance with another preferred embodiment of the present invention.

Referring to FIG. 2 schematically showing an apparatus for producing a low boiling point hydrocarbon oil from waste plastic or waste rubber in accordance with another preferred embodiment of the present invention, waste plastics P is stored in the form of a mixture with powdered acid catalyst C' in a hopper 11. The mixture is expelled by means of a screw conveyer 12 from the hopper 11 and introduced into a thermal decomposing cell 2, in particular, into its lower thermal decomposing chamber 21.

As this powdered acid catalyst, as was described in the previous embodiment, utilization is made of aluminum trichloride ($AlCl_3$), ferric chloride ($FeCl_3$), gallium trichloride ($GaCl_3$), antimony pentachloride ($SbCl_5$), zirconium tetrachloride ($ZrCl_4$), tintetrachloride ($SnCl_4$), etc. The acid catalyst is pulverized so as to powderize its hydrous salts.

A heat furnace 5, including a primary furnace 51 and a secondary furnace 52, is utilized. The primary furnace 51 produces heat gas H1 which is delivered into the thermal decomposing chamber 21, and the secondary furnace 52 produces heat gas H2 which is delivered into the catalytic decomposing chamber 22. The gas G, expelled from a reservoir 6, is burned in the primary furnace 51. Burned gases are utilized as the heat gas H1, which is delivered into the thermal decomposing chamber 21 of the thermal decomposing cell 2. This heat gas H1 heats and thermally decomposes the mixture of the waste plastics P and the powdered acid catalyst C' in the thermal decomposing chamber 21. On the other hand, the heat gases H2, produced in the secondary furnace 52, are delivered into the catalytic decomposing chamber 22 of the thermal decomposing cell 2 to heat the vaporized product produced in the thermal decomposing chamber 21. The inside of the heated decomposing chamber 21 is controlled in temperature in a range of from about 250 to about 450 degrees Centigrade. On the other hand, the inside of the catalytic decomposing chamber 22 is controlled in temperature in a range of from about 120 to about 250 degrees Centigrade. Accordingly, part of the decomposed product, thermally decomposed at a relatively higher temperature within the thermal decomposing chamber 21, is reacted by the powdered acid catalyst and is instantaneously cracked. In the catalytic decomposing chamber 22, the remaining part of the decomposed product comes into contact with the solid acid catalyst of the catalytic layer 22*a* and is cracked at a relatively lower temperature. As a result, the decomposed product is transformed into a vaporized product V, and it is expelled out from the top of the thermal decomposing cell 2.

Temperature control of the thermally decomposing chamber 21 and the catalytic decomposing chamber 22 is accomplished by means of a controller 7. That is, temperatures inside the thermally decomposing chamber 21 and the catalytic decomposing chamber 22 are monitored by thermometers 71 and 72 provided therewithin, respectively. The controller 7 compares the detected temperatures with specified temperatures, respectively, to increase or decrease heat energies delivered into the thermal decomposing chamber 21 and catalytic decomposing chamber 22 by the heat gases H1 and H2, respectively, on the basis of the result of comparison so as to appropriately control the temperatures inside the thermal decomposing chamber 21 and catalytic decomposing chamber 22. Other functions and structures not described above are the same as those of the apparatus of the previous embodiment.

With this embodiment, the waste plastics P mixed with a powdered acid catalyst C' is supplied in the thermal decomposing cell 2, and the controller 7 controls the heat decomposing cell 2 so as to independently maintain the thermal decomposing chamber 21 at relatively higher temperatures and the catalytic decomposing chamber 22 at relatively lower temperatures. Consequently, in thermal decomposing chamber 21, cracking takes place by the aid of reaction of the powdered acid catalyst. This allows the catalytic decomposing chamber 22 to be maintained at relatively lower temperatures, so as to delay the functional deterioration of the solid acid catalyst in the catalytic decomposing chamber 22, thereby extending the durability of the solid acid catalyst.

Figure 3:
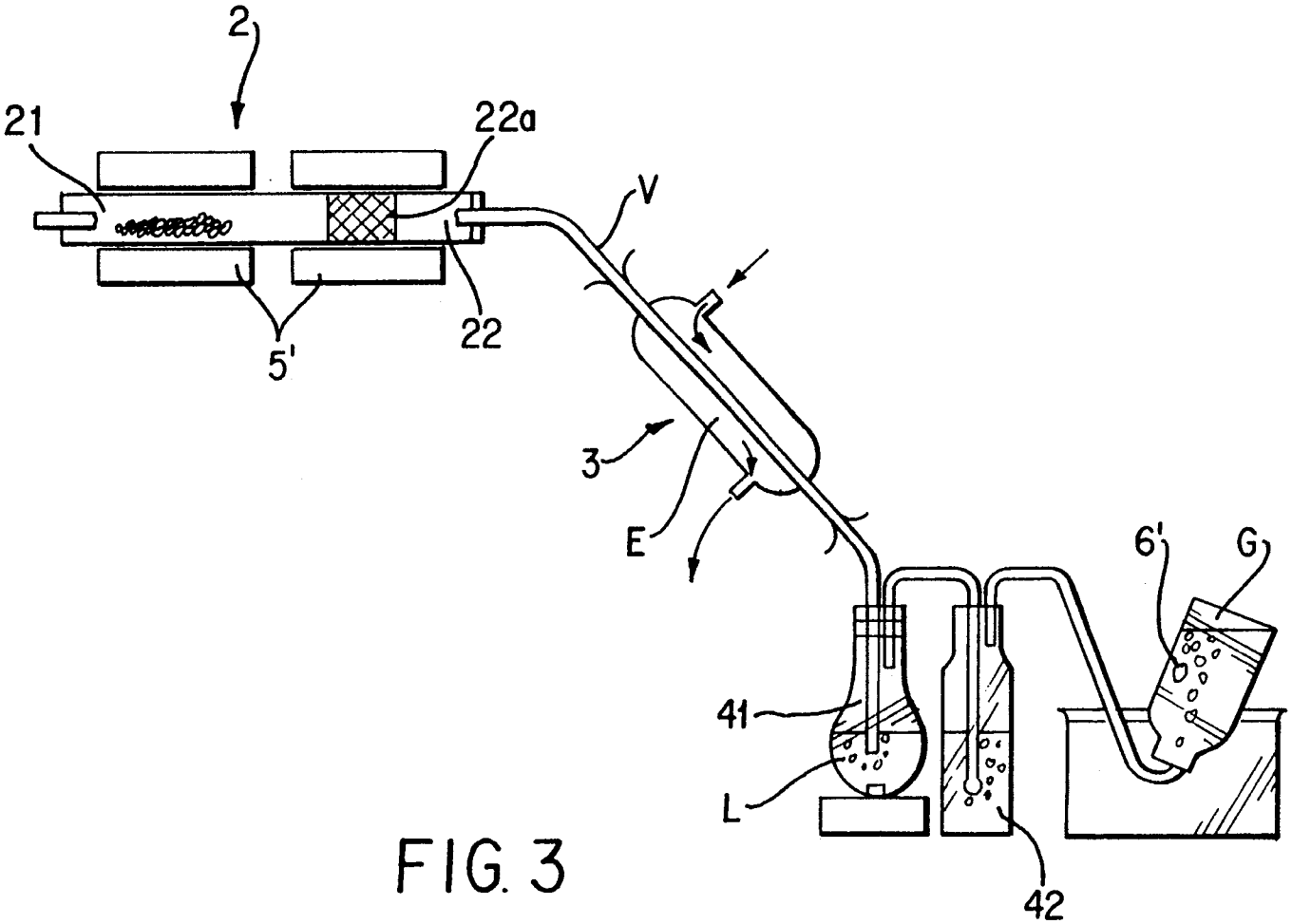
FIG. 3 is a schematic illustration showing an experimental thermally decomposing apparatus used to obtain experimental results of a method of recovering or producing a low boiling point decomposed oil from plastic and/or rubber wastes in accordance with a preferred embodiment of the present invention.

The method has been tested in comparison with a prior art method by the use of a bench scale experimental apparatus shown in FIG. 3 corresponding to the apparatus described above.

Referring to FIG. 3 schematically, showing the experimental apparatus for producing a low boiling point hydrocarbon oil from waste plastic or waste rubber, which is scaled down relative to the practical apparatus, a thermal decomposing cell 2, which is made of a glass pipe, is heated by an electric heater 5' in lieu of a heat gas. However, in order to make test conditions correspond with those of the practical apparatus, the thermal decomposing cell 2 is supplied with nitrogen gas at a flow rate of 500 ml per minute. The upstream chamber of the thermal decomposing cell 2 is used as a thermal decomposing chamber 21, and the downstream chamber is used as a catalytic decomposing chamber 22. A solid acid catalyst, such as $AlCl_3$, is filled in the catalytic decomposing chamber 22 so as to provide a catalytic layer 22*a*. The thermal decomposing cell 2 is pre-heated to a temperature of 450+/−10 degrees Centigrade prior to loading of waste plastics P.

EXPERIMENT I

As waste plastics P, abandoned polypropylene bumpers and vinylchloride sheet covers which are pulverized were tested. A mixture of 5 weight percent of polypropylene bumper waste and 1 weight percent of vinylchloride sheet cover waste was filled in a magnetic ceramic plate and placed in the thermal decomposing chamber 21 of the thermal decomposing cell 2. Both thermal decomposing chamber 21 and catalytic decomposing chamber 22 of the thermal decomposing cell 2 were heated at between 250 and 450 degrees Centigrade by the electric heater 5' so as to accomplish thermal decomposing of the mixture of the waste plastics P.

A vaporized product V, produced by thermal decomposition, was heat exchanged with ethanol E as a cooling agent and cooled in a cooling means 3. A resultant decomposed oil L was neutralized by means of a 30% aqueous solution of ammonia in a primary neutralizing tank 41. On the other hand, decomposed gas G was separated in the primary neutralizing tank 41 and further neutralized by a 30% aqueous solution of ammonia in a secondary neutralizing tank 42 by means of contact reaction. The neutralized gas was collected in a bottle 6'. After the completion of thermal decomposition of the waste plastics P in the thermal decomposing cell 2, the top clear part of liquid in the primary neutralizing tank 41 was collected as a decomposed oil product.

In addition, for comparison purposes, the same processes of the experimental manufacturing test as above were conducted for abandoned polypropylene bumpers which contains no chlorine type of plastics at all. Furthermore, substitution was made of a zeolite (ZSM5) catalyst in place of the $AlCl_3$ catalyst in the same experimental manufacturing test as above. The experimental results are shown in Tables I and II. Table I shows the yield of a decomposed oil at various decomposing temperatures.

TABLE I

| Waste Plastics | Decomposing Temp. (°C.) | Yield of Decomposed Oil: $AlCl_3$ Catalyst (%) | Yield of Decomposed Oil: ZSM5 Catalyst (%) |
|---|---|---|---|
| PP | 200 | 45–48 | — |
| & | 250 | 75–77 | 48–50 |
| VC | 350 | 88–92 | 43–45 |
| | 450 | 90–95 | 37–41 |
| | 500 | 73–78 | — |
| PP | 250 | 72–74 | 70–74 |
| | 350 | 86–90 | 65–67 |
| | 450 | 88–90 | 46–51 |

PP: Polypropylene
VC: Vinyl Chloride

As apparent from Table I, with the use of the $AlCl_3$ catalyst, as the decomposing temperature increases, the yield of decomposed oil product increases, and shows the maximum yield at 450 degrees Centigrade. This trend seems to apply despite of the existence of a chlorine type of plastics. Therefore, the use of $AlCl_3$ catalyst enables treating waste plastics without any influence of a chlorine type of plastics.

In this regard, with the use the zeolite catalyst, the yield of decomposed oil product is less than with the use of the AlClhd 3 catalyst. Especially, if waste plastics contains a chlorine type of plastics, the yield is reduced less than approximately half, and accordingly, the zeolite catalyst cannot be used with chlorine types of plastics.

Table 2 is an experimental result showing the compositions of the decomposed oil or compositions of component carbon numbers.

TABLE II

| Component Carbon Number | Composition of Decomposed Oil: $AlCl_3$ Catalyst (%) | Composition of Decomposed Oil: ZSM5 Catalyst (%) |
|---|---|---|
| $C_4$–$C_6$ | 8.7 | 8.6 |
| $C_7$–$C_8$ | 49.4 | 55.4 |
| $C_9$–$C_{10}$ | 25.4 | 21.8 |

TABLE II-continued

| Composition of Decomposed Oil | | |
|---|---|---|
| Component Carbon Number | $AlCl_3$ Catalyst (%) | ZSM5 Catalyst (%) |
| $C_{11}$–$C_{14}$ | 16.5 | 14.2 |

As is clear from Table II, there is little difference between the compositions of the decomposed oils produced with the use of the zeolite catalyst and the $AlCl_3$ catalyst, respectively. Accordingly, the use of the $AlCl_3$ catalyst, in lieu of the zeolite catalyst, enables the manufacturing of a low boiling point hydrocarbon oil, available as a raw material of fuel oil of naphtha, which is sufficiently comparable to that produced with the use of the conventional catalyst.

EXPERIMENT II

An experiment was conducted to produce a low boiling point hydrocarbon oil from a mixture of waste plastics and rubber. For this experiment, a test substance was made of a mixture of 5 g. of polyethylene as a waste plastic and 5 g of chloroprene rubber as a waste rubber, and was placed in the experimental device shown in FIG. 3. 2 g of $AlCl_3.6H_2O$ was used to formed a catalytic layer 22*a*, having a diameter of 2 cm and a length of 1 cm, within the thermal decomposing cell 2. In the thermal decomposing chamber 21 of the thermal decomposing cell 2, 10 g. of test material was placed. In order to thermally decompose the test mixture, the thermal decomposing chamber 21 and the catalytic decomposing chamber 22 were separately heated at 450 and 250 degrees Centigrade, respectively. The result of the experiment shows that even if waste plastics contain rubber, the thermal decomposing method in accordance with the present invention provides an appropriate production of decomposed oil.

In comparison, the same experiment was conducted with only a substitution of the catalyst with 2 g. of zeolite (ZSM-5) catalyst. The experimental results are shown in Table III.

TABLE III

| Yield of Decomposed Oil from Chloride Rubber | |
|---|---|
| Catalyst | Yield (%) |
| $AlCl_3 . 6H_2O$ | 45–51 |
| Zeolite (ZSM-5) | 30–37 |

As indicated in Table III, where utilization was made of $AlCl_3.6H_2O$ in accordance with this invention, the decomposed coil is recovered at a high yield of 45–51%, without any production of wax. On the other hand, with the conventional zeolite catalyst, the decomposed oil is recovered at a yield of 30–37% which is lower, with a production of approximately 2 g of wax. These results confirm the superiority of the thermal decomposing method of this invention.

EXPERIMENT III

Recovery experiments were conducted to recover a decomposed oil from only synthetic rubber wastes in the thermal decomposing method in accordance with this invention. 10 gm of a test substance of styrene-butadene rubber was placed in the experimental device shown in FIG. 3 with 2 mg. of $AlCl_3.6H_2O$ catalyst in the form of a catalytic layer 22*a* having a diameter of 1 cm. and a length of 1 cm., filled within the thermal decomposing cell 2. The thermal decomposing chamber 21 was heated and maintained at 450 degrees Centigrade. On the other hand, the catalytic decomposing chamber 22 was heated at temperatures of 200, 250, 350 and 450 degrees Centigrade respectively, in several experiments producing a decomposed oil. The results of these experiments indicate that a decomposed oil is sufficiently recovered from synthetic rubber only. Experimental results are shown in Table IV.

TABLE IV

| Yield of Decomposed Oil from Synthetic Rubber | |
|---|---|
| Temperature in Catalytic Decomposing Chamber (°C.) | Yield (%) |
| 200 | 13–17 |
| 250 | 15–20 |
| 350 | 20–25 |
| 450 | 20–30 |

Recovery experiments, conducted as apparent from Table IV, show an increase of temperature in the catalytic decomposing chamber 22 accompanies an increase in yield of a decomposed oil. However, since a temperature increase causes remarkable functional deterioration of the catalyst, it is suggested that the temperature of the catalytic decomposing chamber 22 be desirably maintained in a temperature range of from 120 to 250 degrees Centigrade.

EXPERIMENT IV

Recovery experiments were conducted to recover a decomposed oil from natural rubber wastes only in the thermal decomposing method in accordance with this invention. As test substances, 10 gm of natural rubber particles are used. Excepting heating the catalytic decomposing chamber 22 at temperatures of 250 and 450 degrees Centigrade, all experimental conditions were held unchanged from those in Experiment III. The experimental results of these experiments show that a decomposed oil is sufficiently obtained from natural rubber only. The experimental results are shown in Table V.

TABLE V

| Yield of Decomposed Oil from Natural Rubber | |
|---|---|
| Temperature in Catalytic Decomposing Chamber (°C.) | Yield (%) |
| 250 | 13–19 |
| 450 | 15–23 |

EXPERIMENT V

Recovery experiments were conducted with the use of catalysts other than $AlCl_3.6H_2O$ to recover a decomposed oil. Specifically, utilization was made of three different types of catalysts, such as a $FeCl_3.6H_2O$ catalyst, a $SnCl_4.5H_2O$ catalyst and a $ZnCl_2$ catalyst. In each case 2 mg of catalyst was used. On the other hand, 10 gm of polypropylene was utilized as a waste plastic substance. Excepting these, all conditions were held unchanged from the previous experiments. As a result, in comparison with the utilization of an $AlCl_3.6H_2O$ catalyst, it was found that the recovery yield of decomposed oil is considerably low, and a great amount of wax is produced. For this reason, in order to thermally re-treat the wax, the thermal decomposing process is repeated twice.

The experimental results show that these catalysts, i.e. the $FeCl_3.6H_2O$ catalyst, the $SnCl_4.5H_2O$ catalyst and the $ZnCl_2$ catalyst, excepting the $AlCl_3.6H_2O$ catalyst, are effectively available although they provide poor yields of recovery of decomposed oil. The experimental results are shown in Table VI.

TABLE VI

| Solid Acid Catalyst | Yield of Decomposed Oil: Yield in First Step Thermal Decomposition Oil(%) | Yield in First Step Thermal Decomposition Wax(%) | Yield in Second Step Thermal Decomposition Oil(%) | Yield in Second Step Thermal Decomposition Wax(%) |
|---|---|---|---|---|
| $FeCl_3.6H_2O$ | 18–22 | 70–75 | 30–40 | 40–50 |
| $SnCl_4.5H_2O$ | 11–13 | 50–60 | 20–24 | 24–41 |
| $ZnCl_2$ | 8–11 | 55–65 | 14–19 | 43–57 |

EXPERIMENT VI

A $FeCl_3.6H_2O$ catalyst was used. Waste plastics were prepared as a mixture of 5 part of polypropylene and one parts of a chlorine type of plastic, such as polyvinylchloride. All other conditions were the same as those of Experiment V. Experimental results are shown in Table VII along with the results of an experiment in which only polypropylene was utilized as a waste plastic for comparison purposes.

TABLE VI

| Waste Plastics | Yield of Decomposed Oil: Yield in First Step Thermal Decomposition Oil(%) | Yield in First Step Thermal Decomposition Wax(%) | Yield in Second Step Thermal Decomposition Oil(%) | Yield in Second Step Thermal Decomposition Wax(%) |
|---|---|---|---|---|
| PP & PVC | 18–22 | 70–75 | 30–40 | 40–50 |
| PP | 11–13 | 50–60 | 20–24 | 24–41 |

Note:
(1) The yield in the second step of thermal decomposition includes the yield in the first step of thermal decomposition.
(2) $FeCl_3.6H_2O$ catalyst was used.
(3) PP indicates polypropylene.
(4) PVC indicates polyvinyl-chloride.

From the results shown in Table VI, it is understood that when a chlorine type of plastic is included in waste plastics, the yield of recovery of decomposed oil becomes higher.

EXPERIMENT VII

In order to recognize the appropriate amount of a catalyst mixed with waste plastics which are thermally decomposed in the thermal decomposing chamber 21 of thermal decomposing cell 2, experiments of recovery of a decomposed oil were conducted for various amounts of catalyst. Experimental waste plastics were prepared as a mixture of high density polyethylene with a $AlCl_3.6H_2O$ catalyst. The thermal decomposing chamber 21 and the catalytic decomposing chamber 22 were, respectively, heated at 450 and 250 degrees Centigrade. The experimental results are shown in FIG. 4.

Figure 4:
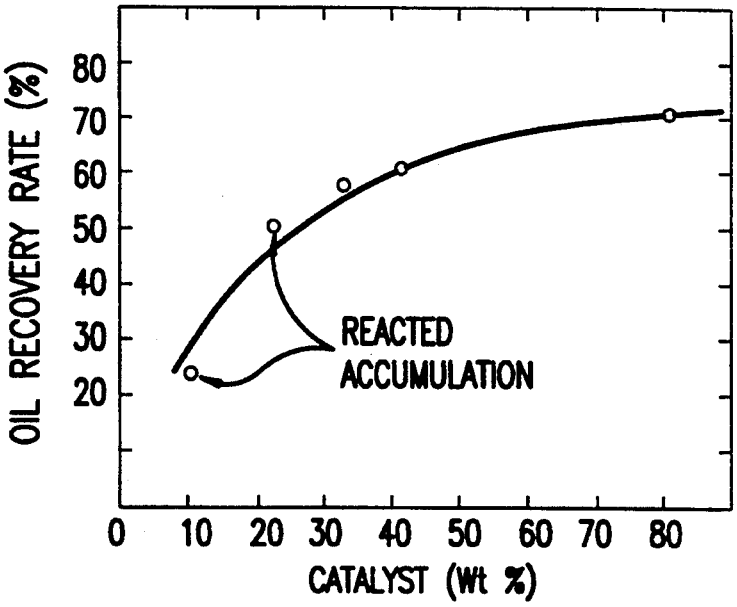
FIG. 4 is a diagram showing the relation between the added quantity of a catalyst and the yield of recovered decomposed oil.

As is understood from FIG. 4, when high density polyethylene is thermally decomposed, it is suitable to mix the waste plastic with approximately 30–80 weight % of catalytic material based on the weight of waste plastic.

EXPERIMENT IIX

Figure 5:
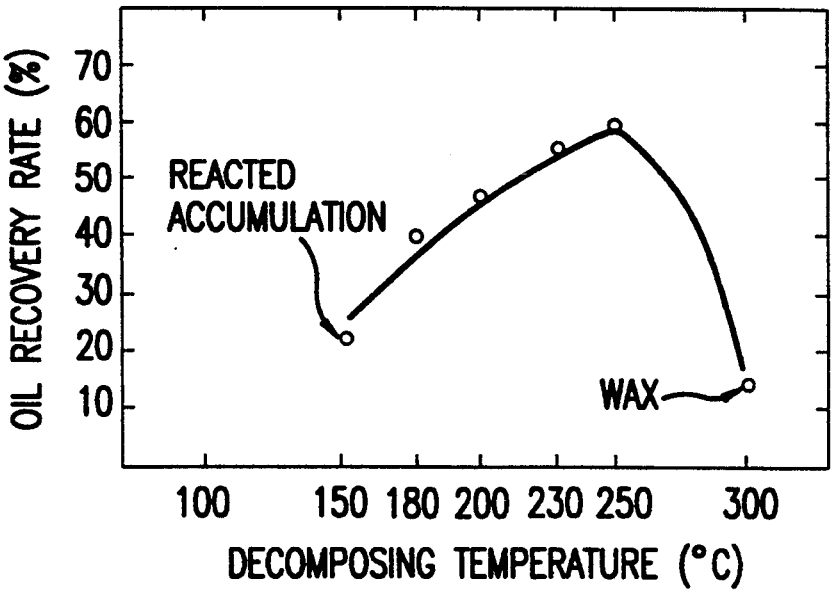
FIG. 5 is a diagram showing the relation between the catalytic decomposing temperature and the yield of recovered decomposed oil.

In order to know the possible temperatures in the catalytic decomposing chamber 22 of the thermal decomposing cell 2, the yield of recovery of a decomposed oil was measured for various temperatures. Experimental waste plastics were prepared as a mixture of high density polyethylene with 30 weight % of $AlCl_3.6H_2O$ catalyst. The thermal decomposing chamber 21 was maintained at 450 degrees Centigrade. The $AlCl_3.6H_2O$ catalyst was used as the catalytic layer 22*a* in the catalytic contact decomposing region 22. Recovery of a decomposed oil was made in the two steps of thermal decompositions as was previously described. The experimental results are shown in FIG. 5. As is understood from FIG. 5, the optimum temperatures of the catalytic decomposing chamber 22 is within a range of from 180 to 250 degrees Centigrade. If the catalytic decomposing chamber 22 is lower than 180 degrees Centigrade, reacted particles accumulate on the catalyst substances of catalytic layer 22*a* and promote the functional deterioration of the catalyst. In addition, if the catalytic decomposing chamber 22 is higher than 250 degrees Centigrade, then an undesirably excessive amount of wax was produced.

It is also to be understood that although the present invention has been described in detail with respect to preferred embodiments thereof, various other embodiments and variants may occur to those skilled in the art. Such other embodiments and variants fall within the scope and spirit of the invention and are intended to be covered by the following claims.

What is claimed is:

1. A method of producing a low boiling point hydrocarbon oil from waste plastic materials, comprising the steps of:

heating waste plastic materials so as to thermally decompose them, thereby producing a vapor product; and bringing said vapor product into contact with a solid Lewis acid catalyst containing hydrochloric acid as a catalytic decomposing activator so as to crack said vapor product, thereby producing a low boiling point hydrocarbon oil.

2. A method as defined in claim 1, wherein said heating of said waste plastic materials is performed at a temperature between 250 and 450 degrees Centigrade.

3. A method as defined in claim 1, wherein said vapor product is brought into contact with said solid Lewis acid catalyst at a temperature between 250 and 450 degrees Centigrade.

4. A method as defined in claim 1, wherein said solid Lewis acid catalyst comprises at least one of aluminum chloride, ferric chloride, tintetrachloride and zinc chloride.

5. A method as defined in claim 4, wherein said waste plastic materials are heated at a temperature between 250 and 450 degrees Centigrade, and said vapor product is brought into contact with said solid acid catalyst at a temperature between 250 and 450 degrees Centigrade.

6. A method of producing a low boiling point hydrocarbon oil from waste plastic materials, comprising the steps of:

preparing a mixture of waste plastic materials, a solid Lewis acid catalyst and hydrochloric acid as a catalytic decomposing activator;

heating said mixture to thermally decompose said waste plastic materials, thereby producing a vapor product; and bringing said vapor product into contact with a solid acid catalyst containing hydrochloric acid as a decomposing activator so as to crack said vapor product, thereby producing a low boiling point hydrocarbon oil.

7. A method as defined in claim 6, wherein said waste plastic materials are heated at a temperature between 250 and 450 degrees Centigrade, and said vapor product is brought into contact with said solid acid catalyst at a temperature between 120 and 250 degrees Centigrade.

8. An apparatus for producing a low boiling point hydrocarbon oil from waste plastic materials, said apparatus comprising:

material supply means for supplying pulverized waste plastics to the apparatus;

thermally decomposing means for heating said pulverized waste plastics to produce a vapor product containing an oil component and a gas component from said pulverized waste, said thermally decomposing means being divided into a thermally decomposing chamber, in which said pulverized waste plastics are thermally decomposed, and a catalytically decomposing chamber;

a solid Lewis acid catalyst, including hydrochloric acid as a catalytic decomposing activator, provided in said catalytically decomposing chamber add contacting said vapor product so that it is cracked thereby;

cooling means for cooling said vapor product to condense said oil component;

gas-liquid separation means for separating the condensed oil component from said gas component; and heat means for burning said gas component separated by said gas-liquid separation means and providing heat gas to said thermally decomposing means.

9. An apparatus as defined in claim 8, wherein both said thermally decomposing chamber and said catalytically decomposing chamber are heated at a temperature between 250 and 450 degrees Centigrade.

10. An apparatus for producing a low boiling point hydrocarbon oil from waste plastic materials, said apparatus comprising:

material supply means for supplying pulverized waste plastics to the apparatus;

thermally decomposing means for heating said pulverized waste plastics to produce a vapor product containing an oil component and a gas component from said pulverized waste, said thermally decomposing means being divided into a thermally decomposing chamber, in which said pulverized waste plastics are thermally decomposed, and a catalytically decomposing chamber;

a solid acid catalyst including hydrochloric acid as a catalytic decomposing activator, provided in said catalytically decomposing chamber and containing said vapor product so that it is cracked thereby;

cooling means for cooling said vapor product to condense said oil component;

gas-liquid separating means for separating the condensed oil component from said gas component; and heat means for burning said gas component separated by said gas-liquid separation means and providing heated gas separately to said thermally decomposing chamber and said catalytical decomposing chamber so as to heat said thermally decomposing chamber at approximately 450 degrees Centigrade and said catalytically decomposing chamber at a temperature between 120 and 250 degrees Centigrade.

11. An apparatus as defined in claim 10, and further comprising heat controlling means for controlling temperatures of said heated gas separately for said thermally decomposing chamber and said catalytically decomposing chamber.

* * * * *